United States Patent [19]

Szegda

[11] Patent Number: 4,869,679

[45] Date of Patent: Sep. 26, 1989

[54] CABLE CONNECTOR ASSEMBLY

[75] Inventor: Andrew Szegda, Canastota, N.Y.

[73] Assignee: John Messalingua Assoc. Inc.

[21] Appl. No.: 214,409

[22] Filed: Jul. 1, 1988

[51] Int. Cl.[4] ..... H01R 13/52

[52] U.S. Cl. ..... 439/272; 439/277; 439/548

[58] Field of Search ..... 439/578–585, 439/675, 271–283, 587, 588, 592, 548, 559

[56] References Cited

U.S. PATENT DOCUMENTS

| | | | |
|---|---|---|---|
| 3,155,448 | 11/1964 | Korsgren, Jr. | 439/271 |
| 4,355,855 | 10/1982 | Rebikoff | 439/275 |
| 4,382,651 | 5/1983 | Klosin et al. | 439/272 |
| 4,655,417 | 1/1986 | Dussel et al. | 439/275 |
| 4,702,710 | 10/1987 | Dittman et al. | 439/271 |

FOREIGN PATENT DOCUMENTS

| | | | |
|---|---|---|---|
| 0168460 | 3/1906 | Fed. Rep. of Germany | 439/271 |
| 0877518 | 12/1942 | France | 439/271 |
| 0482473 | 6/1954 | Italy | 439/271 |

*Primary Examiner*—David Pirlot

*Attorney, Agent, or Firm*—Samuels, Gauthier, Stevens & Kehoe

[57] ABSTRACT

A connector assembly for connecting a cable to an externally threaded port comprising a tubular connector body with an internally threaded connector element thereon, a resiliently deformable sealing element having a first portion tightly encircling the port and a second portion tightly encircling the connector element, the diameters of the two portions defining to provide a stepped internal shoulder, the internal shoulder including a truncated conical surface defining a circular internal sealing lip being deformably engaged by the end of the connector elememt and axially compressed between the connector element and a port abutment surface.

3 Claims, 1 Drawing Sheet

CABLE CONNECTOR ASSEMBLY

BACKGROUND OF THE INVENTION

1. Field of the lnVention

This invention relates generally to cable television systems, and is concerned in particular with an improved cable connector assembly for use in such systems.

2. Description of the Prior Art

In cable television and other similar communication systems, the coaxial cable connectors have traditionally been the source of frequent trouble, resulting in high maintenance costs. Such connectors are usually located outdoors, or in underground vaults, where they are exposed to moisture, extreme temperature variations, and in many cases, tampering by unauthorized personnel. Moisture ingress into the connector will cause eventual deterioration of the signal carrying capabilities of the cable. Experience has shown that 20–40% of cable system service calls stem from such connector problems.

A number of attempts have been made at improving the moisture resistance of coaxial cable connectors. These include:

(a) wrapping the connector with electrical tape;
(b) enclosing the connector within a flexible boot which is slid over the connector from the cable;
(c) applying a shrink-wrapping to the connector;
(d) coating the connectors with plastic or rubber cements; and
(e) employing tubular grommets of the type disclosed in U.S. Pat. No. 4,674,818 (McMills et al) issued on June 23, 1987.

For various reasons, all of the foregoing attempts have yielded less that satisfactory results. For example, attempts at encapsulating the connectors with tapes, shrink wrappings and plastic or rubber cements are too prone to installation errors, resulting in exposed seams and/or internal voids where moisture can collect and eventually penetrate to the cable junction. Moreover, shrink wrappings require the use of heat or chemicals which further complicate installation procedures. Cements require time to set up and cure, thus also prolonging and complicating installation procedures. The use of sealing components such as externally applied flexible boots and/or grommets again results in internal voids where moisture can collect.

SUMMARY OF THE INVENTION

A primary objective of the present invention is the provision of an improved connector assembly, including a specially adapted sealing element, which avoids or at least substantially minimizes the above-described deficiencies of prior art methods and devices.

A related objective of the present invention is the provision of a connector assembly which is simple to install and which provides optimum sealing integrity without potentially troublesome internal voids.

These and other objects and advantages of the present invention are achieved by providing a connector assembly of the type adapted to connect a cable to a conventional externally threaded port protruding beyond an abutment surface. Such ports are typically found on traps, cable junctions boxes, etc.

The connector assembly includes a tubular connector body attached at one end to the cable and carrying a rotatable internally threaded female connector element at its opposite end. A resilient deformable tubular sealing element is axially inserted onto the port prior to threading the female connector element thereon. The sealing element is internally contoured to provide a stepped configuration. Tightening of the female connector element causes the sealing element to become axially compressed between the abutment surface and the female connector element, thereby completely filling any internal voids which might otherwise entrap moisture.

In an alternate embodiment of the invention, the connector assembly further includes an externally applied additional sealing element which mechanically engages the first mentioned sealing element and which is secured to the cable by an external clamiing ring.

DETAILED DESCRIPTION OF PREFERRED EMBODIMENTS

Figure 1:
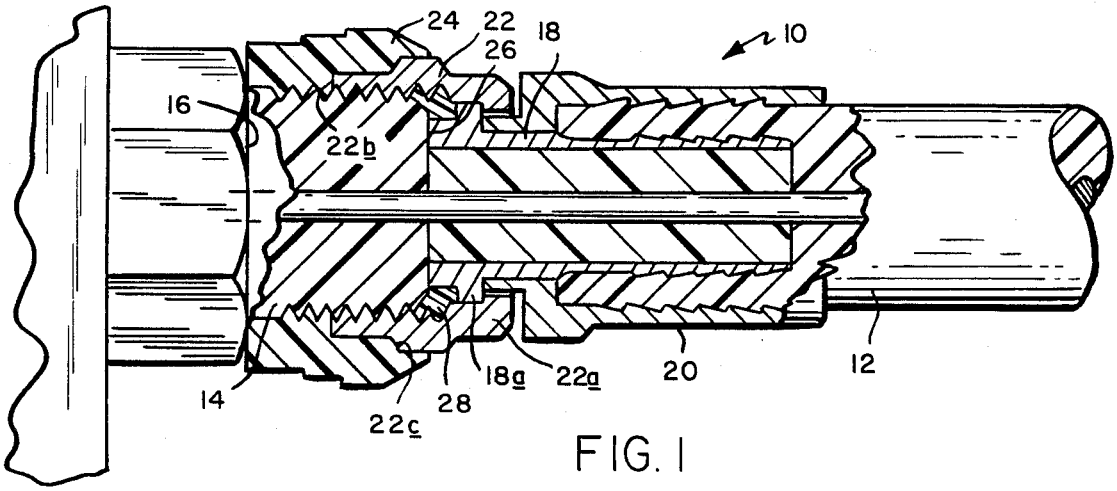
FIG. 1 is a cross-sectional view showing one embodiment of a oonnector assembly in accordance with the present invention.

Referring initially to FIG. 1, a connector assembly in accordance with the present invention is generally depicted at 10. The connector assembly is shown establishing a connection between the end of a coaxial cable 12 and an externally threaded port 14 protruding axially beyond a radially projecting abutment surface 16.

The assembly includes a tubular connector body 18 having an external sleeve 20. One end of the connector body is inserted into the cable 12 and is attached thereto by crimping the external sleeve 20 to clinch the cable therebetween. The opposite end of the connector body carries a rotatable internally threaded female connector element 22 having an internal shoulder **22*a* at one end adapted to engage an external shoulder 18*a*** on the connector body.

Figure 2:
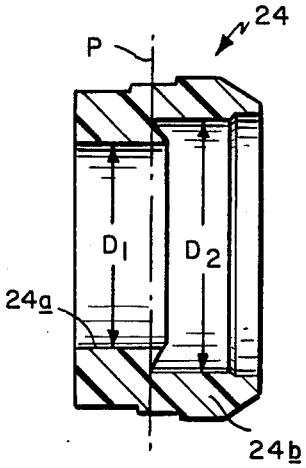
FIG. 2 is a cross-sectional view on an enlarged scale of the sealing element shown in FIG. 1.
Figure 3:
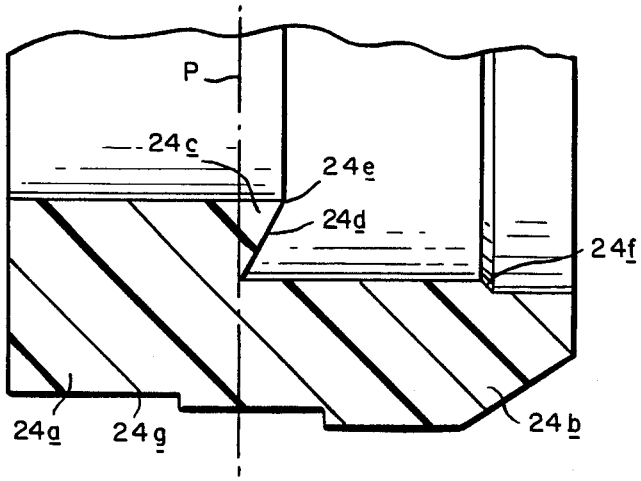
FIG. 3 is a further enlarged partial cross-sectional view of the same sealing element.

A resiliently deformable tubular sealing element 24 is received axially on the threaded port 14. With reference to FIGS. 2 and 3 it will be seen that the sealing element 24 has first and second portions **24*a*,24*b* respectively located on opposite sides of a reference plane P. The first portion 24*a* has an internal diameter $D_1$ which is smaller than the internal diameter $D_2$ of portion 24*b*. The two portions 24*a*, 24*b* define an internally stepped configuration having an internal shoulder 24*c*. Shoulder 24*c* includes a truncated conical surface 24*d* defining a circular internal sealing lip 24*e* overhanging the second portion 24*b*. An oppositely inclined truncated conical surface 24*f* is located at the end of portion 24*b* opposite to that which is overhung by the lip 24*e***.

The sealing element portion **24*b* is adapted to tightly encircle the connector element 22, and the sealing element portion 24*a* is likwise adapted to tightly encircle the threaded port 14. As herein employed, the term "tightly encircle" is intended to define an interference fit which is sufficient to maintain a friction connection between components without producing significant radial distortion of the sealing element. Thus for example, diameter $D_1$ will typically be 0.335 inches with the external diameter of the port 14** being 0.375 inches. Similarly, the diameter $D_2$ will typically be 0.415 inches to mate with an exterior surface of the connector element having an external diameter of 0.425 inches.

When making the cable connection, the sealing element 24 is axially received on the port 14. The female connector element 22 is then threaded onto the end of the port 14 and tightened until the internal shoulder 22*a* grips the external shoulder 18*a* and pulls the connector body 18 into a tightly abutting relationship with the end of the port as at 26. A ring seal 28 will be compressed between shoulder 18*a* and the end of the port. As this occurs, one end 22*b* of the connector element will axially engage and flatten the sealing lip 24*e*, causing the first portion 24*a* of the sealing element to become axially compressed between the connector element end 22*b* and the abutment surface 16. At the same time, an external shoulder 22*c* on the connector element will axially engage the internal surface 24*f* of the sealing element, thereby axially compressing both portions 24*a*,24*b* between the abutment surface 16 and the shoulder 22*c*.

It thus will be seen that the seal element portion 24*a* having a reduced diameter $D_1$ tightly encircles that segment of the port which lies between the abutment surface 16 and the end 22*b* of the connector element. Moisture is precluded from penetrating between the abutment surface 16 and the seal element portion 24*a* because the latter is in axial compression and thus held in tight sealing engagement with surface 16. The relationship between the sealing element portion 24*a*, the underlying port segment and the associated axially engaging surfaces 16 and 22*b* is substantially free of voids that might otherwise entrap or collect moisture.

The axial engagement between the internal conical surface 24*f* and the external shoulder 22*c* prevents moisture from penetrating between the opposite end of the sealing element 24 and the connector element 22. Here again, voids are substantially eliminated along internal interfaces due to the combined axial compression of both sections 24*a* and 24*b*.

Figure 4:
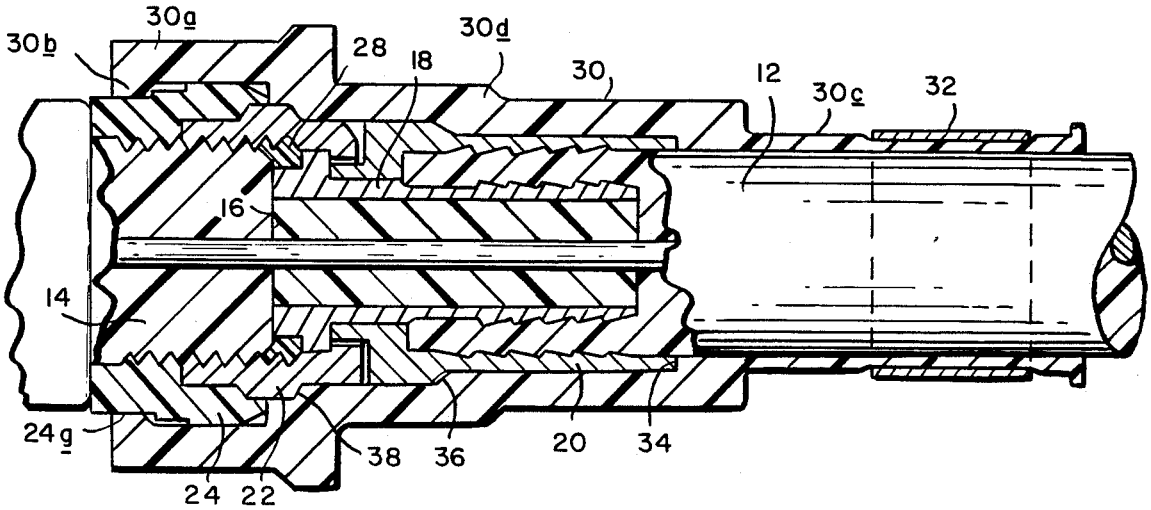
FIG. 4 is a cross-sectional view of a second embodiment of a connector assembly in accordance with the present invention.

A further embodiment of the invention is illustrated in FIG. 4, where like parts have been designated by the same reference numerals. In order to further enhance the moisture proof characteristics of the connector assembly while also enhancing security against tampering, this embodiment includes a second sealing element in the form of a resiliently deformable external cylindrical boot 30. The boot is initially slid onto the cable 12 before attaching the connector assembly to the cable end. Once the cable connection is made, the boot is slid back along the cable and onto the connector assembly. One end 30*a* of the boot tightly encircles the sealing element 24. Preferably, the end 30*a* includes an internal circular lip 30*b* received in an external circular recess 24*g* in sealing element 24. The opposite end 30*c* of the boot tightly encircles the cable 12. A clamping ring 32 is crimped around the end 30*c* to secure the boot in place and to insure sealing integrity. The intermediate portion 30*d* of the boot tightly encircles both the sleeve 20 and the female connector element 22. The boot 30 is internally contoured and stepped as at 34,36,38 to conform to the shape of internal components and thereby eliminate or at least significantly minimize internal voids.

The boot 30 serves and an external covering which protects the internal connector assembly components from exposure to the elements. In addition, the boot and its clamping ring 32 provide a means of visually ascertaining whether the connector assembly has been subjected to tampering. This is because it is necessary to cut the ring 32 away in order to remove the boot and gain access to the inner components of the connector assembly.

I claim:

1. A connector assembly for connecting a cable to an externally threaded port protruding beyond an abutment surface, said assembly comprising: a tubular connector body; means for attaching said connector body to said cable; an internally threaded female connector element rotatably carried on said connector body, said female connector element being threadable onto the end of said port and having an end therof axially spaced from said abutment surface by a segment of said port; and a resiliently deformable tubular sealing element having a first portion tightly encircling said port segment and having a second portion tightly encircling said connector element, said first portion having an internal diameter which is smaller than that of said second portion to define an iternally stepped configuration with an internal shoulder, said internal shoulder including a truncated conical surface defining a circular internal sealing lip overhanging said second portion, said internal sealing lip being deformably engageable by the said end of said connector element to thereby cause said first portion to be axially compressed between said abutment surface and said connector element.

2. A connector assembly for connecting a cable to an externally threaded port protruding beyond an abutment surface, said assembly comprising: a tublar connector body; means for attaching said connector body to said cable; an internally threaded female connector element rotatably carried on said connector body, said female connector element being threadable onto the end of said port and having an end thereof axially spaced from said abutment surface by a segment of said port; a resiliently deformable first tubular sealing element having a first portion tightly encircling said port segment and having a second portion tightly encircling said connector element, said first portion having an external circular recess and being axially compressed between said abutment surface and the said end of said connector element, and a resiliently deformable second sealing element having one end tightly encircling said first mentioned sealing element, having an opposite end tightly encircling said cable, and having an intermediate portion encircling said female connector element and said tubular body the said one end of said second sealing element having an internal circular lip received in said external circular recess of said first sealing element.

3. The connector assembly of claim 2 further comprising a clamping ring surrounding and crimped onto the said opposite end of said second sealing element.

* * * * *